United States Patent [19]

Swanson

[11] Patent Number: 4,473,462

[45] **Date of Patent: * Sep. 25, 1984**

[54] TREATMENT OF PETROLEUM AND PETROLEUM RESIDUES

[75] Inventor: Rollan Swanson, Beatty, Nev.

[73] Assignee: Chemroll Enterprises, Inc., New York, N.Y.

[ * ] Notice: The portion of the term of this patent subsequent to Aug. 28, 2001 has been disclaimed.

[21] Appl. No.: 486,979

[22] Filed: Apr. 20, 1983

Related U.S. Application Data

[63] Continuation-in-part of Ser. No. 471,687, Mar. 3, 1983.

[51] Int. Cl.[3] ..... C10G 47/06

[52] U.S. Cl. ..... 208/59; 208/10; 208/108; 208/112; 502/344

[58] Field of Search ..... 208/108, 111, 112, 11 LE, 208/10, 59; 252/439

[56] References Cited

U.S. PATENT DOCUMENTS

| | | | |
|---|---|---|---|
| 1,300,816 | 4/1919 | Cobb | 208/229 |
| 1,413,005 | 4/1922 | Cobb | 208/230 |
| 1,729,943 | 10/1929 | Hofsass | 208/144 |
| 1,899,042 | 2/1933 | Molisoff | 208/209 |
| 1,904,586 | 4/1933 | Winkler et al. | 208/8 R |
| 1,938,672 | 12/1933 | Ruthruff | 208/230 |
| 1,974,724 | 9/1934 | Rosenstein | 208/229 |
| 2,145,657 | 1/1939 | Ipatieff et al. | 208/143 |
| 2,379,654 | 7/1945 | Royer | 208/213 |
| 2,950,245 | 8/1969 | Thomsen | 208/348 |
| 3,112,257 | 11/1963 | Dauwes | 208/216 R |
| 3,185,641 | 5/1965 | Cowden | 208/226 |
| 3,252,774 | 5/1966 | McMahon et al. | 48/214 R |
| 3,354,081 | 11/1967 | Aldridge | 208/235 |
| 3,368,875 | 2/1968 | Tulleners | 422/190 |
| 3,382,168 | 5/1968 | Wood et al. | 208/264 |
| 3,383,304 | 5/1968 | Mattox et al. | 208/230 |
| 3,483,119 | 12/1969 | Ehrler | 208/264 |
| 3,553,279 | 1/1971 | Dawa | 585/635 |
| 3,565,792 | 2/1971 | Haskett | 208/208 M |
| 3,617,529 | 11/1971 | Thompson et al. | 208/210 |
| 3,663,431 | 5/1972 | Warner | 208/143 |
| 3,745,109 | 7/1973 | Heredy et al. | 208/107 |
| 3,787,315 | 1/1974 | Bearden, Jr. et al. | 208/208 M |
| 3,788,978 | 1/1974 | Bearden, Jr. et al. | 208/208 M |
| 3,816,298 | 6/1974 | Aldridge | 208/112 |
| 3,926,775 | 12/1975 | Schroeder | 208/10 |
| 3,933,475 | 1/1976 | Swanson | 75/21 |
| 3,944,480 | 3/1976 | Schroeder | 208/10 |
| 3,957,503 | 5/1976 | Swanson | 75/77 |
| 3,960,513 | 6/1976 | Agarwal et al. | 44/1 R |
| 4,003,823 | 1/1977 | Baird, Jr. et al. | 208/108 |

(List continued on next page.)

FOREIGN PATENT DOCUMENTS

| | | |
|---|---|---|
| 161778 | 3/1955 | Australia . |
| 597489 | 5/1960 | Canada . |
| 590724 | 7/1947 | United Kingdom . |

OTHER PUBLICATIONS

Letoffe, et al., "Determination des Enthalpies de Formation Polysulfures de Potassium," *Journal de Chimie Physique,* 71, pp. 427–430, 1974.

Thomas, John S. and A. Rule, "The Polysulfides of the Alkali Metals", *Journal Chemical Soc.,* Part 3, pp. 1063 et seq, 1917.

Biltz and Wilke-Dorfurt, *Z. Anorg. Chem.,* vol. 48, pp. 297–318, 1906, (See also *Bor,* pp. 43–53, 1905).

van Krevelen et al., *Fuel,* 38, 256, 1959.

Mazumdar, B. K., et al., *Fuel,* 41, 121–128, 1962.

Hugot, *Ann. Chim. Phys.,* vol. 21, pp. 5–87 at 72, 1900.

Klemm, W., *Z. Anorg. Chem.,* Band 241, pp. 281–304, 1939.

Bergstrom, F. W., *J. Amer. Chem. Soc.,* vol. 48, pp. 146–151 at 147, 1926.

(List continued on next page.)

*Primary Examiner*—Delbert E. Gantz
*Assistant Examiner*—Anthony McFarlane
*Attorney, Agent, or Firm*—Fred A. Keire

[57] ABSTRACT

A process for converting into lighter viscosity products the heavy fractions of petroleum or other hydrocarbon containing components; catalysts especially suitable therefor and a process for this conversion have been disclosed; by further upgrading, the obtained products can be usefully employed as fuels and the like.

25 Claims, 1 Drawing Figure

U.S. PATENT DOCUMENTS

| | | | |
|---|---|---|---|
| 4,007,109 | 2/1977 | Baird, Jr. et al. | 208/108 |
| 4,018,572 | 4/1977 | Swanson | 44/1 R |
| 4,030,893 | 6/1977 | Keller | 44/1 B |
| 4,057,422 | 11/1977 | Swanson | 75/86 |
| 4,078,917 | 3/1978 | Swanson | 75/101 R |
| 4,119,528 | 10/1978 | Baird, Jr. et al. | 208/108 |
| 4,127,470 | 11/1978 | Baird, Jr. et al. | 208/108 |
| 4,147,611 | 4/1979 | Miasek et al. | 208/108 |
| 4,147,612 | 4/1979 | Miasek et al. | 208/108 |
| 4,155,717 | 5/1979 | Sun et al. | 44/1 R |
| 4,160,721 | 6/1979 | Swanson | 208/230 |
| 4,192,735 | 3/1980 | Aldridge et al. | 208/108 |
| 4,210,526 | 7/1980 | Swanson | 208/230 |
| 4,230,184 | 10/1980 | Blytas | 208/230 |
| 4,248,693 | 2/1981 | Swanson | 208/11 R |
| 4,248,695 | 2/1981 | Swanson | 208/232 |
| 4,313,818 | 2/1982 | Aldridge et al. | 208/108 |

OTHER PUBLICATIONS

Feher, F. and H. Berthold, *Z. Anorg. Chem.*, pp. 245–249 at 247, 1953.

Thomas and Rule, *J. Chem. Soc.*, 2819, 1914.

Eibeck, R. E., *Dissert. Abstract*, Ann Arbor, Mich., 21, p. 3254, 1961.

Renegade and Costeanu, *Compt. Rend.*, L.156, pp. 791–793, 1913.

Renegade and Costeanu, *Academie des Sciences*, Seance due 30 Mars 1914, pp. 946–946, (1914).

Sabbatier, *Ann. Chim. Phys.*, 22, pp. 5–97, 1881.

Marrony, *J. Chim. Phys.*, 56, 214–221, 1959.

Auroux, Mme. Aline, *C.R. Acad. Soc.*, Paris, 274, pp. 1297–1300, Mar. 1972.

Kuster und Heberlein, "Beitrage zur Kenntnis der Polysulfide", *Z. Anorg. Chem.*, pp. 53–84, Nov. 1904.

Hamburger, Anna, "Uber die Festen Polyjodide der Alkalien, ihre Stabilitat und Existenzbedingungen bei 25°", *Z. Anorg. Chem.*, vol. 50, pp. 403–438, 1906.

"Alicyclicity of Coals: An Appraisal", *Fuel*, vol. XLI, pp. 105–111, 1962.

"Dehydrogenation of Coal by Iodine", *Fuel*, vol. 39, pp. 179–182, 1960.

"Dehydrogenation of Coal and Tar Formation", *Fuel*, vol. 37, pp. 112–119, 1959.

Foppl, H. et al., "Die Kristallstrukturen von—$Na_2S_2$ und $K_2S_2$,—$Na_2S_2$ und $Na_2Se_2$", *Z. Anorg. und Allgemeine Chem.*, Band 314, pp. 12–20, 1962.

Helms, Alfred et al., "Die Struktur der Sogenannten Alkalitetroxyd", *Z. Anorg. und Allgemeine Chem.*, Band 241, pp. 96–106, 1939.

Goubeau, Josef et al., "Die System Kaliumsulfat-Kaliumsulfid", *Z. Anorg. und Allgemeine Chem.*, Band 236, pp. 45–56, 1938.

Klemm, Wilhelm, "Das Magnetische Verhalten der Kaliumpolyoxyde und —Polysulfide", *Z. Anorg. und Allgemeine Chem.*, Band 225, pp. 273–280, 1935.

Mazumdar, B. K., "Alicyclicity and Smoke Emission of Coal", *Nature*, vol. 183, p. 1613, Apr. 4, 1959.

Mazumdar, B. K., "Dehydrogenation Studies on Coal", *Journal of Scientific & Industrial Research*, (India), vol. 17, pp. 509–511, 1958.

Pearson, Thomas Gibson et al., "The Polysulfides of the Alkali Metals, Part III. Potassium", *J. Chem. Soc.*, Part I, pp. 1304–1314, 1931.

Thomas, John Smeath et al., "The Polysulphides of the Alkali Metals, Part V. The Monosulphide and Disulphide of Lithium", *J. Chem. Soc.*, vol. 125, Part II, pp. 2207–2219, 1924.

Thomas, John Smeath et al., "The Polysulphides of the Alkali Metals, Part IV. The Polysulphides of Ammonium," *J. Chem. Soc.*, vol. 123, Part II, pp. 1726–1738, 1923.

Thomas, John Smeath et al., "The Sulphides of Ammonium", *J. Chem. Soc.*, vol. 123, pp. 1181–1189, 1923.

Pollitzer, F., "Uber das Gleichgewicht der Reaktion $H_2S+2J-2HJ+S$ und die Dissoziation des Schwefelwasserstoffs", *Z. Anorg. Chem.*, vol. 64, pp. 121–148, 1909.

Biltz, Wilhelm et al., "Ueber die Pentasulfide des Rubidiums und Casiums", *Berichte*, Part I, pp. 123–130, 1905.

Kuster, F. W., "Beitrage zur Kenntnis der Polysulfide. II.", *Z. Anorg. Chem.*, vol. 44, pp. 431–452, 1905.

Bloxam, W. Popplewell, "Hydrosulphides, Sulphides and Polysulphid of Potassium and Sodium", *J. Chem. Soc.*, vol. 77, pp. 753–770, 1900.

Bloxam, W. P., "The Sulphides and Polysulphides of Ammonium", *J. Chem. Soc.*, vol. 68, pp. 277–309, 1895.

Yu, Falbe, Ed., *Chemical Substances from Coal*, FIG. 47; trans. from German by A. B. vol-Epstein, Moscow, "Chimia", Publishers, 1980.

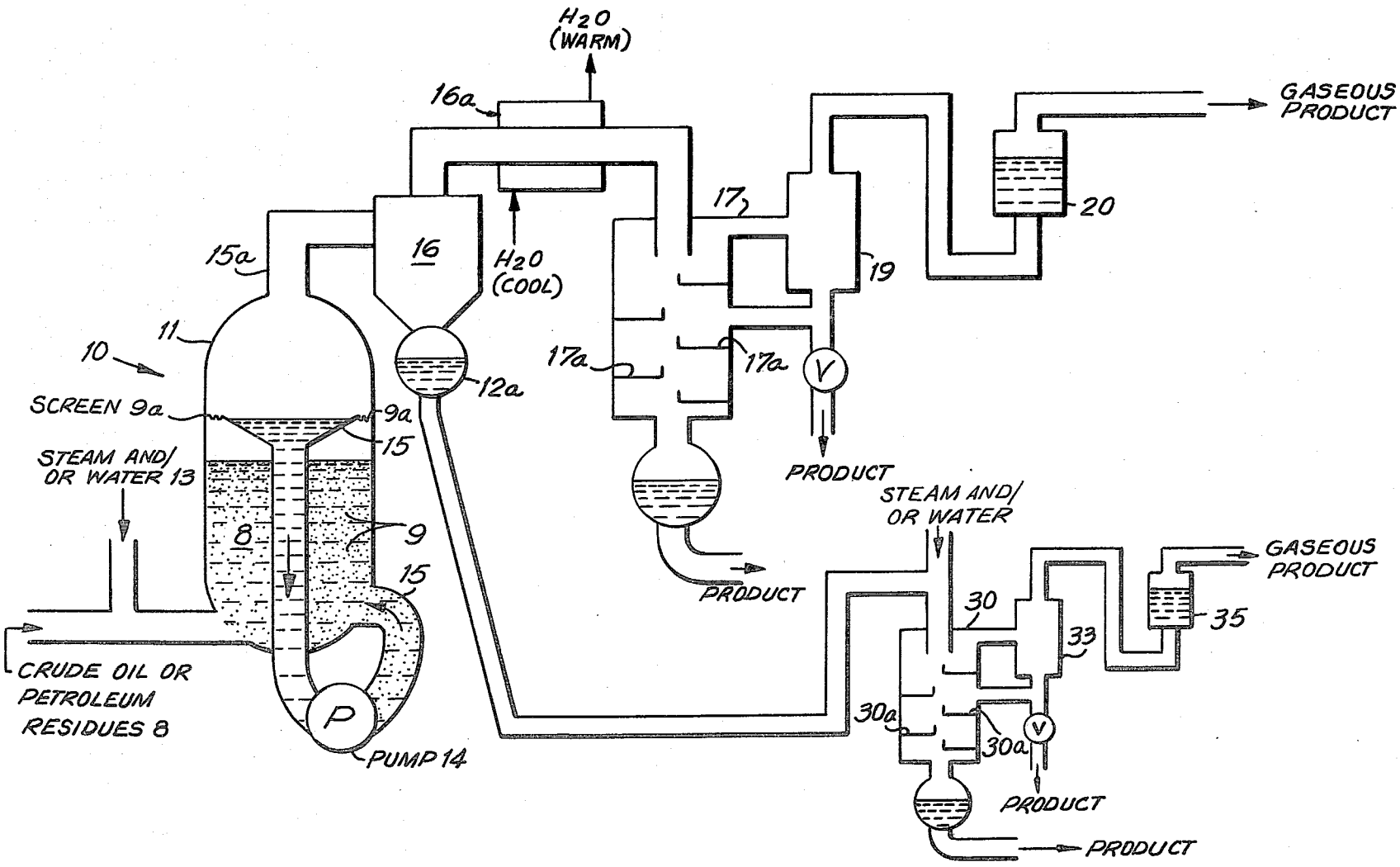
GASEOUS PRODUCT
GASEOUS PRODUCT
35
20
33
PRODUCT
PRODUCT
30a
30
STEAM AND/ OR WATER
30a
19
PRODUCT
17
17a
PRODUCT
17a
$H_2O$ (WARM)
$H_2O$ (COOL)
16a
16
12a
9a
15
9
15
PUMP 14
15a
8
11
10
SCREEN 9a
STEAM AND/ OR WATER 13
CRUDE OIL OR PETROLEUM RESIDUES 8

TREATMENT OF PETROLEUM AND PETROLEUM RESIDUES

This application is a continuation-in-part of my application Ser. No. 471,687 filed Mar. 3, 1983.

This invention relates to the treatment of petroleum and petroleum residues; more specifically, this invention pertains to the treatment of petroleum, petroleum residues in general, but especially high boiling residues according to ASTM D-1180 and D-1160 method, or residual fractions having no boiling points according to these methods or which are destructively distilled with formation of carbon residues. Further, this invention concerns an interdependent treatment of component parts of the above petroleum and petroleum residues for improving the overall yields and space-time velocities including the use of somewhat higher pressures, such as pressures up to 150 psi to aid further in the recovery of the desirable products.

PRIOR ART

In general, the prior art has attempted the upgrading of heavy petroleum fractions with limited success. Many of the petroleum components, as residues, have been especially refractory to further treatment. By stripping all of the oil components from the bottoms, such as by steam stripping and the like, or by further treating of these such as by hydrogen transfer reactions, partial coking, delayed coking and the like, these bottom fractions have been improved and/or further components obtained therefrom. For example, by using a hydrogen donor solvent, some of the hydrogen from the solvent is transferred to the higher boiling petroleum residue fractions and thereby the viscosity of a part of a high boiling fraction is improved such that lighter products are obtained. Typically these reactions are carried out at very high temperatures and with or without the presence of hydrogen under high pressure.

Other methods have been used whereby hydrogen obtained by stripping hydrogen from part of the very refractory residues (i.e. coking) have been used in a parallel stream employing hydrogen as a reactant gas. The obtained coked product is thereafter employed for other purposes or it is burned. The excess hydrogen may also be used such as in the donor solvent system or elsewhere in the refining cycle for improving other refinery residues.

In my previous U.S. application Ser. No. 140,604, published on Nov. 18, 1981 in Great Britian as U.K. Patent Application No. 2,075,542, I have disclosed a process for hydrotreating petroleum residue materials in which the residue material is contacted with steam and with alkali metal hydrosulfides or the empirical monosulfides or polysulfides and/or the hydrates thereof and mixtures of the foregoing to hydrocrack, hydrogenate, hydrotreat, denitrogenate, and/or demetallize and/or desulfurize the carbonaceous material. According to the process disclosed in my above application, the treatment of petroleum and petroleum residues has been considerably improved based on yield, conversion per pass, space-time velocity, API number, etc., such that the process produces upgraded products of greater value.

In my U.S. Pat. Nos. 4,366,044 and 4,366,045 to different processes which relate to the treatment of coal, a number of prior art references are also mentioned. The references as cited in these two patents and as found of record therein provide a background information to the alkali sulfide chemisty and also include, in part, references related to the treatment of crude oil or petroleum refining residues. These references show various attempts in the field to improve the residues or treat various carbonaceous materials. For the sake of convenience, these patents and the prior art cited in these patents are incorporated by reference herein.

Other prior art, based on U.S. patent literature, has been summarized in M.J. Satrian, Editor, "Hydroprocessing Catalysts for Heavy Oil and Coal", Noyes Data Corporation, Park Ridge, N.J., U.S.A. (1982), e.g. pp. 62 to 78. In the U.S. patent literature the following patents have been noted (even though these may have been mentioned inter alia in the above art): U.S. Pat. Nos. 3,520,825; 3,775,346; 3,850,840; 4,117,099; 4,119,528 and 4,203,868. This prior art, however, does not disclose the herein described invention, which represents a further discovery and an invention over my process mentioned in U.S. Ser. Nos. 140,604 or 471,687. This prior art also does not disclose or make obvious the invention in these last two mentioned U.S. applications.

Other less relevant prior art is also found, e.g. in *Fuel*, Vol. 62, Feb. 1983, which issue is devoted exclusively to fundamental studies of catalytic coal and carbon gasifications (cf. Kikuchi et al., "Supported Alkali Catalysts for Steam Gasification of Carbonaceous Residues from Petroleum", ibid., pp. 226 et seq., who report carbon deposits on supported catalysts, generally attempt substantial gasification, and had no cognizance of the role the sulfide series of alkali metals play in these reactions).

Still other art has been disclosed by Sikonia et al., "Flexibility of Commercially Available UOP Technology for Conversion of Resid to Distillates", Publication AM-81-46 of National Petroleum Refiners Association (NPRA), 1981; Ritter et al., "Recent Developments in Heavy Oil Cracking Catalysts", Publication AM-81-44, NPRA, 1981; Bartholic et al., "Utilizing Laboratory Equipment in New Residual Oil Development", Publication AM-81-45, NPRA, 1981.

BACKGROUND FOR THE PRESENT INVENTION

In my previously filed application Ser. No. 471,687 filed on Mar. 3, 1983, I disclose a combination process using an ebullating bed reactor and supported catalysts, as well as a process for treatment of the especially refractory petroleum residues, for example those boiling over 850° F. and especially asphaltenes or the ORA fractions, that is oil, resin and asphaltenes left over from the petroleum refining and characterized as boiling at 1000° F. and higher according to ASTM D-1180 and D-1160 method. My above-disclosed invention represents a successful conversion of the especially refractory bottom products.

My present invention provides a further contribution to the process disclosed in Ser. No. 471,687, as well as discloses a more facile and advantageous treatment of petroleum or crude oil, as a starting feed. The herein disclosed treatment is advantageous for the less completely refined petroleum or crude oil residues. When treating crude oil, substantially no residue remains and the starting material is converted substantially completely to lower boiling point products. This result is accomplished because, according to my process, the severe treatment which produces conventional residua is not applied to the crude oil.

By boiling point, as discussed herein, is meant that the products will be substantially completely distilled according to the defined methods up to that temperature, and no substantial amount of residue remains unless so specified.

BRIEF DESCRIPTION OF THE INVENTION

The present invention distinguishes from the prior art, by employing a specific treatment combination of temperature, pressure, reagents, feeds (and their condition) for the products obtained from a reactor, e.g. an ebullating bed reactor, and the like which products are thereafter subjected to treatment in parallel streams.

It has surprisingly been found that the process first described in my application Ser. No. 471,687 filed Mar. 3, 1983 can be further improved by the parallel treatment of the various products first recovered from the ebullating or a fluidized bed reactor and split in at least two streams as further described herein. It has been found surprisingly that the split stream treatment procedure (i.e. a straight through treatment for the top product from the first gaseous or vapor phase), when applied to the bottoms (obtained by collection in a further separating device such as cyclon), contributes further to the overall conversion of the starting material as a result of the separate treatment of the heavy fractrons which are carried over such as from the ebullating bed. This result is due, in part, to the application of different catalyst combinations to overcome some shortcomings of the catalyst compositions when these are used to treat the highly diverse components of the original feed or the recycle thereof.

This separate treatment of the bottoms in at least one parallel stream (of a smaller, yet initially upgraded fraction) e.g. an ebullating bed reactor, provides a number of benefits.

The catalyst movement in an ebullating bed reactor is about 2 to 40 inches/second/10 to 30 minutes of residence time of a particle feed with about 17 inches/-second/20 minutes of a residence time of particle of feed being average. Additional ebullation is caused by steam and the oil resin and asphaltene feed being fed into the reactor. At the same time this treatment makes it easier to obtain improved throughput rates, yields, conversions, type of products, etc., for the top products from the first stage such that the overall flexibility of the process for treating a wide variety of feed is remarkably aided by this parallel treatment as disclosed herein, especially allowing the split proportions to be tailored to accomodate the various feeds with different component fractions, as well as the mixed product feeds of various source materials which are especially difficult to treat.

In my previous application Ser. No. 471,687, it has been disclosed that some of the products thus collected in the heavy bottom fractions may be recycled but without parallel treatment, but it has now been found contrary thereto that a separate treatment without recycling is still more advantageous in the overall improvement of the products and product yields to be obtained from the wide variety of heavy crude oils, petroleum refining fractions, and the especially refractory component parts therefore. In fact, the method as disclosed herein causes almost an entirely complete recovery of all crude oii components as useful products. The process as disclosed herein is, thus, especially useful because the petroleum fractions which previously were reacted under very severe conditions can be reacted by means of the disclosed catalysts in a less severe, straight through fashion, and yet the very refractory products (by conventional practice), constituting a smaller part of the total mixture and which are the hard to treat, (instead of being initially severely attacked, e.g. bottom reboiled and/or recycled), can now be treated in a parallel treatment with the necessary degree of severity, which severity is still markedly and significantly less than that necessary in the prior art. For sake of convenience, my previous application Ser. No. 471,687 is incorporated herein by reference. Further, this process also applies to other products such as Gilsonite (also known as unitaite, a black lustrous asphalt occurring in Utah), pitch (natural and/or refinery product), tars such as from tar pits found in California, asphalts (natural) such as found in asphalt lakes in Trinidad and of the type found in Utah and like products found in nature or obtained after refinery treatments which concentrate oils, resins and asphaltenes in the residues; slurry oil found in refineries which oil is often without a distillation point; bottom oil from coal gasification plants, e.g. solvent extraction products of coal, or coal extracts such as shown by Satrien, above, p. 206, or bottom fractions of retorted shale oils; heavy bottoms from the Lurgi gasitier process which are produced in operation of the SASOL process in South Africa; delayed cocking products obtained during bottom distillation of these products; resins both hard and soft; and asphaltenes. It is inadvisable to mix some of the feeds, but that can be determined by experiment at the actual reaction conditions. By heavy crude oils is meant crude oils of an API number of about less than 22 including the minus number API crudes.

The combination process as disclosed herein provides further that the more volatile fractions from the petroleum and the like hydrocarbon can be treated in a straight through fashion, but the heavier bottoms, that is the heavier components, especially the more refractory components, are most advantageously treated in a parallel run, thus not impeding or detracting from the overall, first reactor stream yields, and yet improving the bottom products in a separate treatment sequence for improved overall yields.

While the invention has been disclosed with respect to a two reaction train or two stream parallel treatment, equally applicable are further parallel treatments where the refractory products obtained from the second reaction train or stream may be further reacted without recycling.

As a result of the above disclosed combination of steps, the present invention provides for advantageous space-time velocities, yields on an absolute basis, yields per respective parallel pass or combined yields.

As an example, the products thus obtained from a mixed heavy bottom fraction of especially refractory products have yielded end products having a K factor of about 11.71, i.e. highly paraffinnic products, which is achieved by the greater ease the top products from the first reactor are subsequently treated, e.g. to reduce the bromine number and the like.

ILLUSTRATION OF THE PROCESS BY A FLOW SHEET AND DESCRIPTION OF THE DRAWING

In the drawing herein the FIGURE shows schematically a continuous process as a flow sheet depiction wherein the various source materials are converted into useful products.

As illustrated in the drawing, the first stage reactor 10 is an ebullating bed reactor. It may also be a stirred basket or cage type reactor or a fluidized bed reactor. The rotating, i.e. stirred cages or baskets, have not been shown herein. However, inasmuch as the ebullating bed and stirred cage or basket type reactors are very closely related in their actual behavior and performance, these will be discussed as being the same.

The reactor 10 consists of reaction vessel 11 with a catch means such as a funnel 15 at the top and a pump 14 for recirculating the fluid 8 products undergoing the reaction. The feed or fluid 8 may be petroleum or light petroleum residues boiling below about 850° F., but may also be the ORA (oil, resin, asphaltene) boiling above that temperature, e.g. above +1,050° F., i.e. having no boiling point. A catalyst 9 which is in a dispersed, supported form is ebullating with the fluid 8. A screen 9*a* prevents the catalyst from upflowing with the ebullating liquid 8. However, the fluid undergoing the reaction including the catalyst therefor may or may not circulate by the pumping into the reactor through pump 14 because the catalyst may stay suspended in the fluid (for circulating fluid bed reactors) or only a liquid phase freed of the catalyst may be caught in the funnel 15. As shown in the drawing, the ebullating fluid pumped through pump 14 may be introduced anywhere in the reactor, although typically it is introduced near or at the bottom thereof.

The feed 8, of the above-described type, is joined in a single introduction port with steam and/or water 13 or the introduction ports for either of these may be circumferentially around the vessel 11. The refractory components of petroleum, having a longer residence time, undergo the catalyzed reaction and are carried over by the exit conduit 15*a*. This conduit then leads directly into a cyclone 16 which separates the vaporous phase products from the liquid phase and/or entrained products and products carried over with steam from the ebullating bed. More than one cyclone 16 may be used. The cyclone bottom products 12*a* are treated in a separate parallel stream.

The top products coming from the cyclones 16 may be quenched in a quenching zone 16*a* as shown in the drawing, and thereafter immediately reacted in a reaction vessel 17. The products may not be quenched prior to introduction into reaction vessel 17 as quenching may take place therein. The reason for quenching will be explained later.

After the introduction into vessel 17, an appropriate catalyst, as further described herein, supported or unsupported, is suspended, such as schematically shown, on tray 17*a*, or by other means. This catalyst will catalyze the gaseous stream product reaction to produce again a lighter fraction and a heavier fraction or the gaseous steam may be hydrogenated. These bottom products may be recovered such as in a vessel 18, and further treated in a conventional fashion or, as disclosed further herein, may be treated separately in still another parallel stream.

Although not shown in the drawings, additional reaction vessels may be provided in the same stream of a type such as 17. The final recovery of the gases from reflux condenser 19 or other condensers (not shown) may be accomplished in the conventional fashion such as by cooling and/or low temperature chilling and/or pressure condensation and need not be discussed.

It has been found advantageous that the gaseous products of the initial straight through product, after treatment in vessel 17, be further treated at a temperature such as at about 130° C. to about 240° C. in a reaction vessel of the type as shown in the figure at 17. If more saturated products are desired, a reflux column 19, appropriately selected and adjusted, may be employed to collect these products.

The bottoms 12*a*, form the reaction product separated such as in the cylones 16. These are generally the more refractory components of the petroleum or petroleum products. These products 12*a*, although believed to be partially reacted in reactor 10 (e.g. as characterized by the improved API number), are best further treated in a first parallel pass. As these bottom products have reacted to a certain degree due to the catalyst 9 suspended in the ebullating bed, the further reaction is best carried out with another specific catalyst appropriately modified, if necessary, to suit the particular feed.

This second feed stream is thus the bottoms 12*a*, fed to a reaction vessel 30 conjointly with steam, and this co-fed stream lends itself to a catalytic treatment of the still hot feed. The feed 12*a* is more amenable to hydrogenation and thus further improvements are better achieved for obtaining lighter viscosity components of the heavier fractions of petroleum. Feed stream products 12*a* may be advantageously treated with a different catalyst composition in the presence of steam in the same ratio ranges for steam as for the feed fed to the first reactor 11. Various catalyst compositions have been found to be more advantageous from the catalyst which has been originally used in the ebullating bed reactor and designated as 9 therein (due to the partial reaction of the more refractory components in vessel 11). Again, the different catalyst composition for treatment of the various bottom fractions will be further discussed herein.

As the reaction vessel 30 may still be followed with another reaction vessel (not shown), the top products recovered in reflux column 33, from reaction vessel 30, may be further treated. Conventionally, the overhead products from reflex column 33 may be scrubbed in vessel 35 to remove unwanted constituents, e.g. $H_2S$ and the gaseous products thereafter recovered and reused. The reaction vessel 30 may be used in a similar manner as reaction vessel 17, i.e. as an upflow or downflow reactor, with a supported or unsupported catalyst suspended on a bed or on trays 30*a*, or as a fixed bed catalyst. A liquid catalyst, such as hydrated melts of the various alkali sulfides, liquid at the temperature at which these are desired (as previously disclosed by me, e.g. in my U.S. Pat. No. 4,366,044 or application Ser. No. 343,956), may also be employed.

If no further reduction of the molecular size of the overhead distillate product from the first reactor 10, is desired, the overhead distillate product should be hydrotreated in vapor phase reactors, immediately, as it emerges from the cyclone 16 which separates the bottoms (the heavy, partially reacted or unconverted normally recycled stock), from the overhead distillate which is the product. Quenching such as in quencher 16*a* prevents recondensation of the cleaved components. Hydrotreating is aided by the absence of the heavier fractions (removed by cyclone 16). By definition, the hydrotreating is done in the absence of either thermal or catalytic cracking and includes the addition of hydrogen to a molecule. As the hydrogenation reaction is exothermic, the previously described quencher 16*a* helps to control the temperature and prevents product damage if excessive temperatures are encountered.

Fixed bed reactors may be used for this hydrotreating, or liquid catalyst reactors may be used. However, at present, the liquid catalyst reactor appears most effective at temperatures below 280° C., due to the solidification of the catalyst above 280°C., as a result of the hydrate changes.

The fixed bed reactors are less efficient in terms of the degree of hydrotreating achieved from the liquid reactors.

Any cracking, either thermal or catalytic, produces smaller molecules than were present in the feedstock being cracked. A smaller molecule will have a lower temperature boiling point than a larger molecule. Hydrotreating appears not to produce cracking (and thereby form smaller molecules). The boiling point temperature range seems to be approximately the same before and after hydrotreating.

Hydrotreating is effective, for example, in the hydrogenation of olefins to paraffins, and in the elimination of diolefins and triolefins in the product by hydrogenating these diolefins and triolefins to connect these to either monoolefins or paraffins. Aromatics are also converted to naphthenes by hydrotreating. True paraffins appear not to show a reacton during hydrotreating according to my process.

Hydrotreating may also reduce the sulfur and nitrogen content of the product. However, if the asphaltenes, which contain most of the nitrogen, have not previously been cracked, the nitrogen of said asphaltenes is not available for removal by hydrotreating. The degree of sulfur removal and nitrogen removal is equivalent to the hydrotreating of an unsaturated bond (with no hydrogen present at the position at which the hydrogen is to be inserted into the molecule). Those sulfur and nitrogen atoms, in an exposed position in the chemical structure of the product, and which nitrogen or sulfur atoms can be replaced by hydrogen, in a thermodynamically favorable exchange, with the formation of ammonia or hydrogen sulfide and the formation of more saturated molecule of the product, are the sulfur and nitrogen compounds that may be removed by hydrotreating.

The bromine number is a measure of the degree of unsaturation of the product. The lighter unsaturated product cuts will have the highest bromine numbers. The hydrotreating of the product will bring the bromine number down to acceptable levels, e.g. a bromine number of 40–50 for the initial boiling point to 400° F. product (obtained by distillation within that range of the product by the method(s) disclosed above).

As previously mentioned, the bottom products 31 may form a still separate parallel path and may be used as a feed, but these can likewise be recycled because the further reaction pass only introduced further complications. Nevertheless, if the bottom products 31 are difficult to treat, by a further split, these may be subjected to still another treatment stream of the type as shown for feed 12*a*.

Inasmuch as most of the overhead products from reaction vessel 11 are treated in one path straight through, the bottom fractions 12*a* such as collected in cyclone 16 or in the collection vessel 18, constitute products, but of a smaller proportion depending on the component composition of the petroleum. These bottom products may be thus treated in smaller vessels based on the proportion of the components of the petroleum products being treated. Accordingly, various mixtures of petroleum can now be usefully treated depending on the bottom product 12*a* components. The size of the reactor 30 may range in proportion to the bottom components in the petroleum such as those boiling at a temperature of 1000° F. and above.

As previously discussed, the reactors 10 or 30 may be ebullating bed reactors. However, these may be a rotating cage or rotating basket reactor where the baskets are in a stirred tank reactor rotated at a velocity from about 50 to 180 rpm. The catalyst is a supported catalyst in either case for these reactors with the supports such as disclosed in my previous application Ser. No. 471,687.

Steam is being introduced in the reactors 10 or 30 at a rate such that the product sought to be obtained dictates, to a certain extent, the amount of steam being used. The steam may be from about 50 and up to 100 to 130% of the product recovered, by weight. Steam may also be expressed on a basis defining a lower limit, namely such that coking does not occur to any substantial degree due to absence of steam, but which would occur in the reactors 10 or 30 if insufficient steam were present. Thus as a lower limit, the amount of steam introduced must be such that any significant coking is avoided in reactors 10, 17, 30, etc. Additional steam may be supplemented such as for reactors 17, 30, etc. Steam is a low pressure, typically, waste steam.

The temperature in the reactor generally may be up to 650° C., although the most advantageous operating temperature is below 450° C., such as below 425° C. The temperature, however, in the subsequent reaction vessels, e.g. 17, etc., may be lower, and lower temperatures seem to produce a more hydrogenated product, such as characterized by a lower bromine number. However, the more refractory component treatment in reactor 30 may require the same temperature as in reactor 10.

The quenching may be carried out at a temperature of 390° C. and lower. The third stage reactor, not shown herein, may have a temperature as low as in the range of 170° C. and lower, i.e. down to 125° C. (but without condensation of steam). Lower temperatures are desirable because hydrogenation is exothermic and most of the hydrogenation is carried out in the downstream reactors, whereas most of the cracking is carried out in reactor 10, and to a lesser degree in reactor 30.

The pressure in the vessel 11 and downstream thereof may be maintained at an atmospheric pressure. Although subatmospheric pressures are possible, these are not as convenient. If the pressure is up to about 100 psig or below 150 psig (although up to 25 atm. may be used), it seems that the reaction may be improved. When higher pressures are used e.g. between 60 psig and below 150 psig for some unknown reason, these suggest the best range. Steam condensation must be avoided at the higher pressures. Although the exact reason is unknown and the conversion is not understood, it seems to indicate a better hydrogenation in that range, but the increase in pressure carries with it a certain trade-off due to more complicated equipment and more capital investment.

Further, instead of cyclone separation such as depicted in the drawing herein, i.e. one or more of the cyclone 16 being employed, other separation means may be employed to recover the liquid and/or entrained products and thus to accomplish the parallel path treatment of the petroleum components; such other means may be centrifuge separators, knock out drums or the like.

With respect to the materials which may be subjected to the treatment, these are various crude oils from whatever source and of whatever viscosity. These crude oils, as long as these are adequately liquid at the treatment temperature, may be treated and produce the outstanding results as disclosed herein. Atmospheric residues and bottoms at atmospheric conditions obtained from conventional petroleum refining may also be included. These source materials thus are characterized as products which have a boiling fraction of less than about 850° F. However, their component parts or reaction products (from reactor 10) which have a boiling point above 850° F. are best treated in a parallel path as disclosed herein.

The further treatment in the second parallel reaction path will produce products of outstanding and improved viscosity, improved hydrogen content and improved chemical structure (e.g. products are of a higher paraffinnic content with high K values, or aromatic polycyclic compounds which can still thereafter subsequently be treated to produce the desirable, less olefinically unsaturated cyclic compounds and linear or branched paraffinnic products). Hence, the gaseous products obtained by practicing the process herein and the conversion of the unsaturated products to more saturated products is a further contribution to my process previously described.

In hydrotreating the products of this process, in order to reduce the bromine number and to further reduce the nitrogen and sulfur content of said products, it is necessary to keep in mind that the lower temperature hydrotreating aspect does not appear to "crack" the product to any significant degree and thereby form smaller molecules, which in turn would reduce the temperature of the boiling point range. Hydrotreating of the product will render further upgrading, i.e. by cracking (as determined by a lower temperature boiling point range such as the formation of smaller average molecular sizes), more difficult due to the apparent inability in this process to crack paraffins.

The hydrotreating should, therefore, be the final part of the process as disclosed herein and not be used until the desired molecular size has been achieved by the "cracking" aspect of this process. Thus the vacuum residua feedstocks are initially cracked into smaller molecular size, under less severe conditions, and then the refractory residues, i.e. feed stream 12*a*, under the necessary but appropriately severe conditions which do not affect the mainstream products. The resultant product has a lowered temperature boiling point range. Accompanying this molecular size reduction is a reduction in the sulfur and nitrogen content of the top product compared to that of the feedstock.

The resulting smaller molecules which form the "cracked" products do not contain the high amounts of nitrogen of the feedstock. Nitrogen is normally concentrated in the heavy "asphaltene" end of the petroleum residua. Metals are bound through the nitrogen bond to the methyene groupings of the porphyrin ring structure of the asphaltenes, and are thus usefully separated in the parallel reaction path. Therefore, the metals and the nitrogen remain with the unreacted central porphyrin structure of the asphaltenes and are either not present or present in very limited quantity in the overhead distillate product derived from the vacuum residua containing the asphaltenes, which have been concentrated relative to the asphaltene content of the crude which formed said vacuum residua. The metals and the nitrogen are more concentrated in the No. 1 bottoms, e.g. 12*a*, which do not form overhead distillate product. The sulfur content is not necessarily concentrated in the asphaltene portion of the petroleum crude or residuum. The resin portion of the residue may contain as much as 5%, by weight, of sulfur.

With respect to the catalysts which are sometimes also called reagents, these are employed in the form such that these produce the desired results, namely sufficient cleavage and/or scision of the bonds in the first and further parallel stream reactors or the hydrogenation ultimately desired. The results are obtained by first appropriately severely, but not overly severely, treating the first treated product with the further herein described catalysts, and these will be described with reference to the results achieved. Secondly, the pretreated (in reactor 10) refractory components are thereafter appropriately severely treated in the parallel path. Mixtures of the catalysts are also suggested as highly desirable for the crude oils and their residues, or for mixtures of crude oils based on the various crude oil component fractions.

A suitable severe catalyst for reactor 10 is designated as Catalyst A, and it is prepared as follows. A mole of potassium hydroxide is dissolved in either ethanol, methanol, particularly best in ethanol, or an ethanol-methanol mixture, or less advantageously, because of lesser solubility therein, in 1-propanol or 1-butanol. Solubility of the catalyst product is lower in these last two alkanols are larger amounts of the alkanols must be used and subsequently separated. The alkanols may be absolute alkanols, although these may be such as 95% ethanol. The potassium hydroxide is dissolved in this solution and is then reacted with hydrogen sulfide bubbled through the solution. After thorough saturation, the catalyst-alcohol mixture is recovered and the alcohol separated by vacuum aspiration. The residue is the catalyst. For a mixture of solvents, typically one mole of potassium hydroxide is dissolved in 200 cc of ethanol and 130 cc of methanol. Typically, analytical reagent grade pellets of potassium hydroxide (about 86% KOH), absolute ethanol or 95% ethanol and absolute methanol are used. As mentioned above, the proportions of an ethanol-methanol mixture may be varied. The solution is evaporated under vacuum until no more residual alkanol can be removed. These catalysts appear to be best suited for cleavage, and especially for cleavage of the refractory components and, therefore, are used in the appropriate proportions (or solely) with others to achieve the desired cleavage.

Catalyst may be unsupported in the first stage reaction, but most advantageously for the first or subsequent stages it is deposited on supports and calcined.

In all the reactions, the catalyst is allowed to react with the exclusion of atmospheric oxygen and thus in absence of oxygen. Similarly, the deposition of the catalyst on the support is in absence of oxygen as is the driving off of the volatiles from the support.

The catalyst and the support, after the volatiles have been driven off, are heated to an appropriate temperature such as between 320° C. and up to 450° C. or even up to 560° C. The catalyst tightly adheres to the support and may thus be used such as in a spinning-cage (also called spinning basket) reactor, ebullating bed or fluidized bed reactor.

If the support is unduly attacked by the catalyst, such as alumina in the first stage reactor, then the following method is used. The above catalyst is evaporated to considerable dryness, dissolved in glycerol, and the glycerol-catalyst mixture deposited such as on an alumina support. Other less resistant supports to the attack by the catalyst such as a molecular sieve supports are treated similarly. Typically these molecular sieves may be of the Y and X, e.g. YL-82, type, with low sodium content (available from Union Carbide, Danbury, Conn. or comparable supports from Mobil Oil, New York, N.Y.). The molecular sieves function, however, as supports for the catalyst, i.e. to increase the contact area for the catalyst.

The glycerol catalyst mixture after depositing on the reagent is then progressively heated such as up to 560° C. with the volatiles being driven off.

Glycerol may also be first deposited, heated up to about 200° C., and then the catalyst deposited thereon (after the support has been cooled), and then heated to the desired temperature.

The reaction in the first reactor may be at a higher temperature, and may range from about 320° C. to about 450° C. although temperatures up to 560° have been used, even up to 650° C. For asphaltenes, the preferred temperature range is from about 360° C. to about 430° C.; it appears that between 390° C. and 425° C. is a very good operating range.

Inasmuch as for these catalysts the reaction must at all times be conducted in the presence of steam to facilitate the hydrogenation, hydrocracking, etc., steam is used in a ratio such that it is, at minimum, about 27%, by weight, based on the weight of feed such as the ORA fraction, crude, the residues, etc., charged to the above reactors. Conversely, the amount of water charged in the form of steam at the operating temperature may be increased or diminished based on the degree of hydrogenation desired (which also may take place in the first reactor to a certain degree). If more hydrogenation is sought to be achieved, more steam is being introduced, but typically steam does not exceed about 85% weight percent of feed, although 130%, by weight, may be used based on the hydrogenated product being obtained, i.e. withdrawn (if gaseous fraction is being produced then it is converted to a liquid equivalent). Stated on another basis, the amount of water used is determined by subtracting the hydrogen content of the feedstock from the hydrogen content of the desired product, on weight basis and multiplying the amount by 9 (as water is 1/9 by weight of hydrogen). Typically, up to a 30% excess is injected in the first reactor.

If water is not being introduced in the reactor, such as in the form of steam, or is interrupted for one reason or another, then coking is apt to occur; thus carbon is being deposited or generated by a process somewhat similar to catalytic thermal cracking, but in this event the catalyst acts a thermal cracking catalyst, albeit with some advantage (because this catalytic thermal cracking is at a fairly low temperature, e.g. 320° C.), but vastly less efficiently than when it functions in the presence of steam as a hydrogenation and/or cleavage catalyst. Hence, as previously mentioned slight coking may also be taken as a lower, although less desirable, limit for the steam addition.

Intermittent or insufficient steam introduction will also cause production of especially heavy product in the reactor 10. It is important that steam is introduced at all times, in a proper manner in the reactor and thoroughly dispersed (without any steam and/or reagent free space).

Nevertheless, it must be mentioned that excessive amounts of steam also prevent the reaction from being carried out appropriately, apparently by unduly entraining the partially converted products.

If carbon is being laid down for one reason or another, typically it is on the hot spots such as heated reactor walls or catalyst support. Hence, the reactor 10 is preferably operated adiabatically. Carbon deposits on the catalysts can be driven off, that is, converted back into useful product by exposure to steam for a period of time without introducing additional feed, after which the catalyst is useful again and can be used for the production of the desired product cut. Intermittent introduction of hydrogen sulfide or sulfur may be helpful in general and for low sulfide content feedstocks, e.g. sweet crude oils.

Still further, it has been found that if the temperature, such as with the above catalyst, is increased to about 320° C. to 420° C., depending on the feedstock composition (for example its asphaltene composition) an exothermic reaction may take place, e.g. at 440° C. an exothermic reaction sets in. The exothermic reaction may reach temperatures up to 600° C., but it also depends on the amount of steam being introduced. More steam would tend to produce lighter carbon products. Excessive temperatures are not desired, and temperatures below 440° C. are preferred.

In the second stage reactor 17 where further reactions take place, advantageously the products from the first reactor are rapidly cooled to about 250° C. and in the presence of a catalyst, generally between temperatures of 250° C. and 390° C. Quality of product is increased when the process is operated at temperatures up to about 430° C., preferably 425° C., but the conversion apparently will not increase after 390° C. Cooling in quencher **16*a*** is at such a rate that steam does not condense and interfere with the reaction. The light ends, of course, that is hydrogenated products, will not be condensed.

The catalyst in the second reactor 17 again is preferably a supported catalyst but it can be an unsupported catalyst, and the treatment is of the vaporous or gaseous products. A typical catalyst for the second stage reaction, i.e. reactor 17 is a less severe Catalyst B. This catalyst is produced by dissolving a technical or analytical grade of a potassium hydroxide which is approximately 86% potassium hydroxide in absolute or 95% ethanol or methanol (preferably ethanol) and saturated with hydrogen sulfide but without boiling off the alkanol, and by collecting and trapping any alkanol given off in a downstream vessel. Other vessels in which the reaction takes place may be further downstream to catch the hydrogen sulfide. When the last vessel containing KOH shows a reaction, the reaction is stopped in all upstream vessels.

If the reaction is carried out in a further reactor(s) 17, i.e. second stage reactors, the advantages of the process reside in the combination obtained by the immediate quenching of the reaction products from the first stage reactor to about 300° C. but preferably 250° C., in the presence of catalyst, and then conducting these reactions of the first stage products in the second stage. For this purpose, it has been found especially advantageous to support the catalyst on a suitable support. These supports may be the same as in the first stage, but in any event these supports must be inert under the reaction conditions in the particular reactor 17 or 30 of the type as depicted as in the FIGURE. These second stage reactors 17 may be used as fluidized bed (circulatory fluidized bed, partially circulating or confined fluidized bed), fixed bed or liquid bed reactors. Reactor 30 may also be an ebullating bed reactor, or a fluidized bed or circulating fluid bed reactor.

It has been found acceptable for the second stage reactors, e.g. 17, to use the supports of a type commonly available such as alumina-alumina silicates of a fixed zeolite type, i.e. molecular sieve type, with sodium or potassium in the zeolite exchanged with ammonia. Type X and Y zeolites ( 10 and 13 ) are suitable. Type Y molecular sieve zeolites are preferred; of these, the low sodium ratio sieves are especially desirable (i.e. about less than 1.0% $Na_2O$). The molar ratio of silica to alumina of these is about greater than 3 to 1; about 5 to 1, etc.; $Na_2O$ is about 0.2 weight percent. These are available such as from commercial sources, in forms such as powder spheres, cylindrical and other extrudates, etc., of suitable size such as $\frac{1}{8}$ of inch extrudates or spheres. Although these have been alleged to be poisoned or destroyed by alkali metals, as worked up by the below-described procedure, these supports are useful despite the deposition thereon of the herein described alkali sulfide reagents. These supports may also be used in the first stage reactor 10.

Other zeolites are ELZ-L zeolite of the potassium type as described in U.S. Pat. No. 3,216,789, and silicalite material as described in U.S. Pat. No. 4,061,724. The last has a pore dimension of about 6 Angstrom units. Other supports are such as those described in British Patent No. 1,178,186, i.e. the very low sodium type—less than 0.7 percent, by weight, e.g. ELZ-Ω-6, or ELZ-E-6, E-8, or E-10. Other supports are mordenites and erionites with very low sodium content obtained by ammonia exchange and of the calcined type. Of the above molecular sieves, the type Y very low sodium, e.g. 0.15, by weight, ammonia exchanged supports available under Trademark LZ-Y82 from sources such as Linde Division, Union Carbide Corporation, Danbury, Conn., Mobil Oil Corporation, New York, N.Y., and other sources are preferred. In any event, the stability and durability of these molecular sieves used as supports are tested under the reaction conditions and are established by the performance in the second stage reactor.

The preparation procedure for the second stage supports is as follows. The low sodium ammonium exchanged zeolite extrudates, such as powders, cylinders, saddles, stars, rings, spheres, etc., of powder, or extrudates of about $\frac{1}{8}$ to 5/32 or 3/16 inch size are treated with glycerol or like polyhydroxy alkane compounds, such as partially reacted polyhydroxy compounds including up to hexahydric alkanes, by first impregnating these in a reactor which is kept closed. Thereafter, e.g. when using glycerol, by heating and removing decomposition products from these powders, extrudates, or spheres from room temperature up to 265° to 280° and even up to 560° C., an appropriate, but unknown, reaction takes place. The thus reacted support is then screened, drained, and cooled in a closed and tightly sealed container if the temperature has been brought up to 560° C. When cold, the support is then impregnated with a reagent-catalyst of the general formula $K_2S_{1.5}$ (empirical); this catalyst is acceptable, but it is not outstanding for cleavage. This catalyst, designated as Catalyst C, is obtained by dissolving 6 moles of KOH in 9 to 15 moles of $H_2O$ without external heat being applied, and thereafter with a small amount of alkanol, e.g. 2 to 2.5 cc of methanol or ethanol being added per mole of KOH. Then 4 moles of elemental sulfur are added to the foregoing solution which react exothermically. Thereafter, an appropriate amount of sulfur is added for adjusting the catalyst to the desired sulfur level by addition of supplemental sulfur to form the empirical sulfide, i.e. from $K_2S$ but $K_2S_{1.1}$ to $K_2S_{2.5}$, including up to $K_2S_5$ is useful, depending on the desired product cut. For more gas in the product, less sulfur saturated species are used. For more liquids in the product, more sulfur saturated species are used.

Another catalyst, Catalyst D, is prepared as follows. One mole of KOH is disssolved in 1.5 moles of water with vigorous stirring. Then 2 ml of methanol or ethanol are added immediately after KOH has dissolved. Immediately thereafter $\frac{2}{3}$ moles of elemental sulfur are added and are allowed to react by a vigorous reaction. The catalyst is adjusted to the desired empirical sulfur content by adding appropriate amounts of sulfur by further stirring, e.g. one quarter of $\frac{2}{3}$ moles of sulfur adds 0.5 to the empirical sulfur content of $K_2S$; i.e. $\frac{1}{4}$ of $\frac{2}{3}$ moles of dissolved sulfur gives $K_2S_{1.5}$; $\frac{1}{2}$ of $\frac{2}{3}$ moles gives $K_2S_{2.0}$, etc., including other appropriate fractions. Thus the catalyst may range from $K_2S_{1.1}$ to $K_2S_{2.5}$ or even up to $K_2S_5$. The lower sulfur content species, e.g. $K_2S_{1.5}$, are good cleavage catalysts when admixed with Catalyst A and in general for the less severe treatment of crudes. This catalyst is also a hydrogenation catalyst. Catalyst A is generally admixed from 3% to 25% but typically less than 10%, by weight, to Catalyst D.

When the catalyst has been thus prepared, it is vacuum evaporated to a flowing slurry. It is then poured over the glycerol treated, cooled extrudate as described above (i.e. if the support had been heated up to 300° C. or higher), and under very low vacuum, agitated and aspirated until dry. Then the catalyst is further screened when dry and introduced immediately in the second stage reactor which has been purged of air oxygen when used as hydrogenation catalyst.

As another method for protecting the support, if the glyercol treated support is heated between 260° C. to a decomposition point (indicated by appreciable slowing down of a liquid condensate being collected), then the above described catalyst slurry is added and the vessel is covered and heated up to at least 440° C., including up to 560° C. In any event, the catalyst is calcined above the temperature at which the catalyst is used in the process.

Still another method is to mix the glycerol, e.g. about 88 ml of glycerol, to about the one mole (K basis) of the catalyst, in solution, or by admixing the above catalysts or mixtures thereof to glycerol. Then the catalyst-glycerol mixture is heated to drive off water and/or alcohol leaving a glycerol solution of the catalyst. Temperature is brought up to 190° C. for the foregoing. The mixture is then poured over the support and with agitation brought up to at least 450° C. and even up to 560° C. This supported catalyst gives a very unpleasant odor. It must be prepared under well isolated conditions.

In use for a gallon-sized first stage reactor in conjunction with a second stage reactor, up to about $\frac{2}{3}$ of mole of supported catalyst (K basis) is charged to the second reactor. As an example, alumina supported $K_2S_{1.5}$ (empirical) catalyst may be charged to the second stage reactor.

Another catalyst, Catalyst E, is a nonsupported or supported catalyst capable of decreasing the molecular size of the product in a first stage reactor (or used in a further second stage reaction). Catalyst E is obtained by adding a dried KHS powder or slurry in appropriate mole or weight percent increments (based on the desired size of the product) to any of the above-described reagent mixtures A, B, C or D. Either unsupported or supported forms of the catalyst may be used. That is from ⅓ to 1/3 moles on molar basis of K of KHS is added to e.g. $K_2S$ (empirical) sulfide, or to $K_2S_{1.5}$ (empirical), and the molecular size of the product is decreased by these additions of KHS.

When the process is run with the thus supported catalyst in the second stage reactor, appropriate adjustments may be made, e.g. $K_2S_{1.1}$ or $K_2S_{1.5}$ give more hydrogenation, and $K_2S_2$ gives larger molecules (also more distillate, less gases). These reactions are run in a temperature range from 113° C. to 440° C. Similar catalyst adjustments may be made in other reactors, e.g. when more than one second stage reactor 17 is used. In any event, the first stage reaction, however, is carried out with the specified reagent to accomplish the desired degree of cleavage of the refractory, intractable initial source material components, e.g. residues of crude oil, the ORA fraction, and especially asphaltenes. In the parallel treatment then these not yet reacted intractable compounds are then treated catalytically to accomplish the desired degree of cleavage. The total process combination in the further stages, that is second, third, fourth, etc. stages, depends on the specified first stage reaction and removed portion of unreacted constituents and is thus interdependent.

The amount of catalyst deposited on the support is from about 4M of catalyst (K basis) to about 0.5M or as low as 0.1 M (K basis) per 500 cc of support. On another basis, not identical basis, the amount of catalyst is about 20 grams per 300 cc of support, but it may range from 3 grams or 5 grams of reagent per 100 cc of support to about 25 grams to 30 grams per 100 cc of support.

The vanadium may be entirely removed from the petroleum feedstock and the heaviest product may contain essentially all of the vanadium. If run with the presently supported catalysts, the vanadium is analyzed in very small quantities or as non-detectable in the No. 2 bottoms, i.e. product 18. The removal of the nickel is aided if some of the reagent be present in the hydrosulfide form KHS. There is no reaction between the alkali metal sulfides and nickel sulfides but there is a solubility reaction when alkali metal hydrosulfide and nickel sulfides are present. Nickel (and iron) form complexes like ferrites with the alkali metal sulfides-hydrosulfides. These complexes are immediately hydrolyzed in liquid water to form the precipitates of iron or nickel hydroxides. In liquid water, the vanadium complex with the catalyst is highly water soluble and water stable. Iron is normally present in the residue, after distillation range determinations, in amounts between 3 and 5 ppm, but the amount depends also on the amounts in the initial stage.

In general, the catalysts for the second and further stage reactions herein are the hydrosulfides and sulfides, that is, monosulfides and polysulfides of the Group IA elements of the Periodic Table other than hydrogen prepared from the alkanol solution as mentioned above. Although for the stated purpose sodium, potassium, rubidium and lithium may be used, far and away the most advantageous are sodium and potassium. Of these two, potassium is preferred. Although rubidium compounds appear to be acceptable, rubidium, the same as lithium, is not cost-advantageous. However, for the first stage reactor, rubidium may be very advantageous in a blend of rubidium, potassium and sodium, in the following proportions: 14% rubidium, 26% potassium, and 60% sodium sulfides, i.e. the various species thereof, on basis of the elemental metal, by weight. The ratio ranges for the preceding mixture are 1:1.5–2.5:3.5–4.5, respectively, but these compositions must be prepared in the manner as defined according to the procedure described for Catalyst A. The catalysts used are typically used as the hydrates, but a small portion of the catalyst is apparently in the form of an alkanolate (the hydrate analogue), i.e. up to about 15% but typically less than 10% or even less than 5%, by weight. Alkali metal thionates are also present as transitory intermediates. Hydrates (and alkanolates) of these compounds are very complex and undergo a number of transitions during the start-up and as these achieve the reaction conditions. It appears that the presence of mixed hydrates and alkanolates are necessary for the outstanding results. No attempt has been made to elucidate the nature of these transitions or the actual structure at the reaction conditions for the sulfides, hydrates, alkanolates, thionates or the mixtures of each. It is sufficient to indicate, however, that the charged catalyst can be a mixture of a number of hydrates and/or alkanolates or a eutectic mixture of various hydrates and/or alkanolates.

Similarly, during the reaction, as there is interconversion of the sulfur-containing forms of the sulfides, no attempt has been made to characterize this interconversion. However, as mentioned before, if the first stage feed contains sizeable amounts of the refractory components, i.e. asphaltenes of various sizes, resins, and oils such as slurry oils, i.e. more than 50%, by weight, and up, but including up to 95% if a fraction boiling above +1000° F., the first stage reaction requires at least a portion of the specific catalyst, e.g. Catalyst A, as defined above. As the percentage of the more refractory compounds in the feed decrease, less of Catalyst A needs to be used. Similarly for feed **12*a*, Catalyst A is again recommended. It may also be added to other catalyst compositions depending on the desired bond scission (as characterized by API number, viscosity, etc.), as that composition appears best to achieve bond scission or cleavage without excessive gas production. For the No. 1 bottoms, i.e. the feed stream 12*a*, the preferred reaction vessel is an ebullating bed reaction vessel or the stirred cage or basket reactor, further a fluid bed reactor and still further a fixed bed reactor. Another catalyst for feedstream 12*a*** is Catalyst B with 5%, by weight (on elemental K basis) of KHS admixed thereto or replaced in the same proportions including up to 95% of Catalyst A. In general, the order of the catalysts for bond scissions or cleavage of the refractory compounds is as follows: Catalyst A (ethanol prepared species); Catalyst A (methanol prepared species); Catalyst A (methanol-ethanol prepared species); Catalyst A+B (mixture 50% or more Catalyst A on K basis moles); Catalyst D; Catalyst E (about ⅓ moles of KHS added); Catalyst B, and lastly Catalyst C. Of course, increasing the amount of KHS additions to the catalysts will increase the cracking ability.

The order of the catalysts for hydrogenation is as follows: ½ Catalyst A+KOH on molar basis, then add the other half of a (very exothermic hydrogenation reaction); Catalyst C with KHS mixture (based on needed degree of cleavage); Catalyst B+A (50% or more of Catalyst B on K mole basis), and Catalyst B.

It must be remembered that in the above discussion, the refractory nature of the carbonaceous source materials and their components is that assigned to these according to the prior art. By comparison, the present process is carried out at lower temperatures and lower pressures and is capable of converting all of the prior art refractory materials with great advantage and facility. However, as the carbonaceous source materials and their components have a different "refractory" nature according to the present process, e.g. the paraffins are the most refractory while the asphaltenes and aromatics are not; the invention resides in the ability to treat, in a proper sequence, according to this process, with the proper catalysts, all the components of these carbonaceous materials as characterized by heretofore unachievable yields when treating these carbonaceous source materials.

In the following Example, various reactions are described. There is no intent to limit the invention by the Example but merely to illustrate its applicability.

EXAMPLE

In accordance with the above described procedure, a mixed residue feed containing various types of residues designated as FHC-353 was used.

Analysis for the feed is as follows:

| | |
|---|---|
| weight % of below 1000° F. cut | 8.6% |
| API number | 6.6 |
| specific gravity at 60° F. | 1.0243 |
| sulfur, wt. % | 3.91 |
| nitrogen, wt. % | 0.478 |
| hydrogen, wt. % | 10.35 |
| carbon, wt. % | 84.72 |
| oxygen, wt. % | 0.471 |
| Total elements: | 99.9% |
| oils, wt. % | 29.6% |
| resins, wt. % | 57.8 |
| aspaltenes, wt. % | 12.6 |
| Recovery, wt. % | 100% |
| Ramsbottom carbon, wt. % | 21% |
| Metals: | |
| vanadium | 228 ppm |
| nickel | 52 ppm |
| iron | 14 ppm |
| sodium | 4 ppm |
| viscosity | 1430 cts at 100° C.<br>250 cts at 135° C. |
| pour point | 130° F. |

The residue feed was gradually heated up so as not to cause coking until the mixed residue became pumpable or reached the reaction temperature of about 425° C., at which temperature the reaction was conducted in the presence of catalyst and steam. Total feed sample was 15,650 grams, and recovery was 98.1% of the feed charge based on the various condensates obtained.

A boiling point redetermination of this feed residue according to ASTM D-1160 and D-1180 was also carried out on a 200 cc sample of the feed in accordance with the described method and the data obtained were as follows (reported as temperatures observed during the determination):

| | Sample cc | % Recovery | °C. temp. at top of column | °C. temp. of pot | Corrected temp. (D-1160; D-1180) | Pressure in column-mm. of Hg |
|---|---|---|---|---|---|---|
| Initial | 40 | 20 | 240 | 275 | 975 | 4.2 |
| boiling pt. to | 50 | 25 | 253 | 286 | 810 | 4.2 |
| | 60 | 30 | 263 | 295 | 835 | 4.6 |
| | 70 | 35 | 273 | 304 | 858 | 4.2 |
| | 80 | 40 | 283 | 310 | 882 | 4.2 |
| | 90 | 45 | 290 | 316 | | 4.2 |
| | 100 | 50 | 297 | 324 | 907 | 4.2 |
| | 110 | 55 | 305 | 330 | | |
| | 120 | 60 | 312 | 338 | 938 | 4.2 |
| | 130 | 65 | 320 | 344 | 953 | 4.2 |
| | 140 | 70 | 326 | 351 | | 4.2 |
| | 160 | 80 | 319 | 347 | 990 | 2.0 |
| | 170 | 85 | 330 | | | 2.0 |
| | 180 | 90 | 339 | 364 | 1030 | 2.0 |
| | 188 | 94 | 347 | | 1050 | 2.0 |
| | | | 347 | | | |
| | 190 | 99 | 351 | 380 | 1090 | 1.0 |

This product was converted in a stirred basket reactor having a supported catalyst. The support was a Y-82 zeolite from Union Carbide, Danbury, Conn. in the form of a $\frac{1}{8}$ inch extrudates, e.g. flat shapes. The catalyst has an empirical formula of $K_2S_{1.5}$, i.e. prepared as catalyst D above, with 5%, by weight, of Catalyst A added thereto. The amount of catalyst was 20.16 grams per 220 cc of the described support.

Initial conversion of product for first product (top product from reactor 10) was 71% (for combined product except the very volatile, dry ice and iso-propanol cold trap materials and gases). This conversion also does not include the distilled material in the feed recoverable below 1050° F. The top products plus recovered bottoms were accounted for and 98.1% of initial feed charge were recovered , the remainder apparently being the gas and volatile distillates.

A 1,392 gram test sample containing 7 grams of $H_2O$ of top products of reactor 10 and 17 except for the condensates mentioned above had the following component distribution:

| | |
|---|---|
| Initial boiling point to 360° F. | 71.6 grams or 5.24 weight % |
| 360° F. to 650° F. | 203.4 grams or 14.89 weight % |
| 650° F. to 1000° F. | 1084.1 grams or 79.36 weight % |
| Total distilled: | 1359.1 grams. |

The product of reactor 10 and 17 had an initial boiling point to 360° F. product which had the following characteristics:

| | |
|---|---|
| API number | 54.5 |
| specific gravity | .7608 at 60° F. |
| viscosity | 0.72 cts at 100° F.<br>0.568 cts at 150° F. |
| ash content | .009%, by weight |
| nitrogen content | 0.05% |

-continued

| | |
|---|---|
| sulfur content | 1.0%. |

The fraction boiling from 360° F. to 640° F. has the following characteristics:

| | |
|---|---|
| API number | 34.2 |
| specific gravity | 0.8540 at 60° F. |
| water | 0.002%, by weight |
| pour point | −20° F. |
| viscosity | 2.57 cts at 100° F. |
| | 1.61 cts at 160° F. |
| sulfur | 2.18% |
| ash | 0.01%, by weight. |

The fraction boiling to 650° F. to endpoint had the following characteristics:

| | |
|---|---|
| API number | 17.8 |
| specific gravity | 0.9478 at 60° F. |
| pour point | +115° F. |
| viscosity | 37.34 cts at 150° F. |
| | 12.05 cts at 210° F. |
| carbon content | 85.03%, by weight |
| hydrogen | 11.55%, by weight |
| nitrogen content | .26%, by weight |
| Conradson carbon | 2.56%, by weight. |

The recovered residue, i.e. remaining after +1050° F. stage had been reached had:

| | |
|---|---|
| vanadium | 5.6 ppm |
| iron | 48.6 ppm |
| sodium | 8.2 ppm |
| potassium | 22.3 ppm |
| nickel | 0.48 ppm. |

For the vacuum gas oil fraction, i.e. 650° F. and above fraction, the characteristics were as follows. Initial boiling point 652° F. and recovery as follows:

| | |
|---|---|
| 10% at | 732° F. |
| 20% at | 782° F. |
| 30% at | 830° F. |
| 40% at | 878° F. |
| 50% at | 894° F. |
| 60% at | 928° F. |
| 70% at | 948° F. |
| 80% at | 976° F. |
| 90% at | 1018° F. |
| end point at | 1050° F. |
| at 94.4% recovery | |

The K factor for completely treated top products from reactor 10 for the 650° F. plus fraction (hydrogenation as a last step) was 11.71.

The bottoms from the first stage reactor 10 recovered as 12*a* were rerun on a batch basis when sufficient amount were recovered. The catalyst for feed 12*a* was Catalyst A supported on a steel mesh particles of a size of $\frac{1}{8}\times\frac{1}{4}\times 3/16$, of total volume of 200 cc which contained 15.7 grams of catalyst. Total feed sample run was 1286 grams. Total recovery was 750.7 grams (which included also 8 grams from the dry-ice trap but no gas). About 29% of FHC-353 feed were recovered as bottoms. Feed analysis of 12*a* bottoms was:

| | |
|---|---|
| carbon | 84.78%, by weight |

-continued

| | |
|---|---|
| hydrogen | 8.74%, by weight |
| ash | 0.98%, by weight |
| sulfur | 4.64%, by weight |
| Conradson carbon | 40.57%, by weight. |

About 58.4% of feed was converted. On a continuous basis higher conversion would be reached, but on batch basis the dead space in the reactor underneath the spinning cage or basket did not allow complete reaction space, as well as the holdup in transfer lines prevent completion of the reaction.

Combined recovered products had the following characteristics:

| | |
|---|---|
| carbon | 82.24%, by weight |
| hydrogen | 11.95%, by weight |
| oxygen | 0.64%, by weight |
| water | 2.8%, by weight. |

The 360° to 650° F. boiling point fraction has the following characteristics:

| | |
|---|---|
| API number | 27.2 |
| pour point | −15° F. |
| viscosity | 8.533 cts at 100° F. |
| | 4.028 cts at 150° F. |
| nitrogen | .17%, by weight |
| water | 2.8%, by weight |

The fraction boiling 650° C. to endpoint had the following characteristics:

| | |
|---|---|
| API number | 17.4 |
| specific gravity | .944 |
| pour point | +95° F. |
| viscosity | 21.54 cts at 150° F. |
| | 7.989 cts at 210° F. |
| carbon | 84.7% |
| hydrogen | 11.27% |
| oxygen | .66% |
| Conradson carbon | 2.2%, by weight |
| nitrogen | 0.27%, by weight |
| vanadium | 3.5 ppm |
| iron | 7.6 ppm |
| sodium | 1.6 ppm |
| potassium | 10.3 ppm |
| nickel | .45 ppm. |

Distillation residue:

| | |
|---|---|
| carbon | 85.22%, by weight |
| hydrogen | 11.06%, by weight |
| oxygen | .49%, by weight |
| sodium | 3.07 ppm |
| vanadium | N. D. |
| nickel | .344 ppm |
| iron | 4.6 ppm |
| potassium | 27.4 ppm. |

The 650° F.+ product (from feed 12*a*) has the following distillation characteristics for a 191 gram charge of which 163 grams were overhead; it is a 175 ml sample at 60° F. The recovered fractions were as follows:

| | |
|---|---|
| 10% at | 650° F. |
| 20% at | 775° F. |
| 30% at | 830° F. |
| 40% at | 870° F. |

-continued

| | |
|---|---|
| 50% at | 907° F. |
| — | — |
| — | — |
| 80% at | 1030° F. |
| 85% at | 1050° F. |

This distillation and residue product had the following characteristics: API number of 16.4 at 60° F. and 20.0 at 60° F., respectively. Moreover, the low metal content and the fairly high API number make this residue a good feed, e.g. as a catalytic cracker feed.

While the residue was about 15%, it would constitute the bottoms in the reactor vessel, e.g. 30, and these again may be subjected to further treatment, e.g. in a further parallel pass, i.e. the same as for feed 12*a*. The analysis of the reaction vessel residue product was:

| | |
|---|---|
| carbon | 83.99%, by weight |
| hydrogen | 6.88%, by weight |
| oxygen | 2.9%, by weight |
| water | .05%, by weight |

Based on the combined 58.37% (recovered product divided by weight of feed stock with accountability of 83%) conversion (rerun of bottom products from reactor 10 feed 12*a*) and the top products of reactor 10 but not counting in for the last the dry ice trap liquids and not the recovered gases for the top products of reactor 10 and not the supposed distillable products (supposedly still in FHC-353 feed distilling below +1050° F.), the total conversion is 87.9%; however, if gases and dry ice cold trap products are counted on an average molecular weight basis of 49 and the volume converted to weight, including the actual distillate content of FHC-353, then the actual recovery is even higher.

The yields in the above examples have been calculated on a basis to render the interpretation of these yields consistent with the conventional practice. The conversion on a space-time velocity may also be calculated, i.e. the starting material treated per unit volume of the catalyst for that starting material per a given unit of time.

The yields are conventionally calculated on the basis of the total amount of starting material used and converted with a fraction of a component boiling at a boiling point of less than +1,050° F. included. The boiling points are determined by the previously described methods, which are the conventional methods used in the petroleum industry. In petroleum industry practice the limit of +1050° F. is used to describe the very refractory crude or distillation product components according to the conventional methods.

The yields may also be based on a proportion of the components converted to a lighter viscosity product such as on a degree of API product basis. The residues such as collected by the cyclones 16 and used as feed 12*a* are calculated into the yields as add-ons to the initial amount of starting material treated and recovered. The residue from vessel 30 boiling at or over 1,050° F. is then subtracted from the overall collected material, provided this residue is not further treated.

In some practice the yields are based on the treatment of residues having certain boiling points, namely residues boiling more than at 650° C. and less than 850° C. or like limits, and then to consider only the convertible fraction by conventional processes (whatever that process is for the particular refiner). Inasmuch as that basis is not useful for evaluating the present process because the present process converts nearly all the previously unconvertible residues, it is believed best to characterize the products which are recovered in the straight-through run and the first and second (if necessary) parallel run products distillable at less than 1050° F. being add-ons. That is after the first run products and second or third parallel run products are added together including any further reaction vessel, e.g. 17, etc., including all condensed products, etc., and these are combined and a distillation is carried out as described and the residues boiling above +1050° F. are subtracted for the conversion calculations, the yields may then be determined.

For best practice, the gaseous hydrocarbon products in the feed distillable at less than 1050° F., the low temperature condensibles and gas are included. Gas can be included on a calculated basis such as average molecular weight calculated for the volume collected, converted to a weight percent to provide for accountability of all products.

According to the above description and pursuant to the Example as disclosed herein, it is believed that the specific treatment of the split or separated fractions from petroleum crude, low boiling point residues, up to 850° F., or high boiling point residues up to and over 1050° F., in a straight-through fashion at low pressures and low temperatures allows the conversion of almost the entire crude oil or petroleum or other hydrocarbon values into usable products if a second or further treatment of the bottom fractions is practiced with the specifically selected catalysts.

Heretofore considerable effort had to be devoted to the conversion of the intractable portions of crude oil or petroleum residues into useful components, but the yields have been low and numerous recycles had to be conducted to achieve acceptable yields. If it is remembered that about up to 50% of these intractable portions had to be subjected to the very severe treatment, the present process, which provides considerably higher yields and better end products, high space-time velocity, etc., while utilizing poorer starting product or separately treating the split product at less drastic conditions, then it is evident that the present process stands out as a great contribution in the continuous search for obtaining all useful products from a given volume of crude oil, or its residue.

What is claimed is:

1. In a process for converting carbonaceous starting materials having refractory components therein, without addition of hydrogen as a reactant gas, to products of lower viscosity and/or end products that are more hydrogenated, said converting being in presence of an alkali metal sulfide catalysts, the improvement comprising:

(a) reacting, in a first reaction zone in the presence of added water in form of steam and a catalyst, at least one carbonaceous starting material of a heavy crude oil, a natural asphaltic material, a natural tar, a natural pitch, a Gilsonite, a slurry oil, a solvent extracted asphaltene; a pitch or a tar derived from coal; oil, resin and asphaltene mixtures; or an oil-resin-asphaltene fraction of a distillate having a boiling point of about 850° F.+ and higher; a distillation residue having no boiling point below destructive distillation of same; a coal oil extract; a bottom fraction of retorted shale oil; a heavy bottom from coal gasifiers of SASOL type; a delayed coking product distillation bottoms or mixtures of the foregoing, said catalyst comprising said alkali metal sulfide catalyst in admixture with a cleavage catalyst of at least 5% for treating in said first reaction zone the refractory components in said starting material, wherein said cleavage catalyst is defined as Catalyst A and is prepared by dissolving a mole of potassium hydroxide in an ethanol, methanol, an ethanol-methanol mixture, 1-propanol, or 1-butanol to obtained a potassium hydroxide solution, reacting the potassium hydroxide solution with hydrogen sulfide bubbled through the solution, recovering a catalyst-alcohol mixture and separating said alcohol from said catalyst-alcohol mixture;

(b) recovering a top reaction product from said first reaction zone, including gases as vaporous or gaseous products;

(c) separating as bottom products a parallel stream from the products from said first reaction zone, said products being liquid products, or partially pretreated refractory components in said starting materials;

(d) reacting in the presence of initially introduced steam, or added steam, and as a sole feed, the separated bottom products obtained from said first reaction zone in the presence of said admixture of cleavage catalyst A as defined in (a) above and said alkali metal sulfide catalyst, and (e) recovering the products produced in step (d).

2. The process as defined in claim 1 wherein in step (a) and step (d) the catalysts are metal supported catalysts.

3. The process as defined in claim 1 wherein the top vaporous or gaseous reaction products of step (b) or step (d) are reacted further, directly, or after cooling of same, in at least one additional reaction zone, for hydrogenation of same, in presence of a supported or unsupported catalyst and added steam, wherein the catalyst comprises an alkali metal hydrosulfide, sulfide, polysulfide, a hydrate of a sulfide, a hydrate of a polysulfide, or mixtures thereof such that the bromine number of said obtained products is reduced compared to the bromine number in products of step (b) or step (d).

4. The process as defined in claim 1 wherein the catalyst in step (a) or step (d) is a supported catalyst and comprises Catalyst A, or Catalyst A up to 95%, on K mole basis of Catalyst A, in admixture with Catalysts B, C, D, or E, each of said catalysts being prepared as defined herein after:

wherein Catalyst A is prepared by dissolving a mole of potassium hydroxide in an ethanol, methanol, an ethanolmethanol mixture, 1-propanol, or 1-butanol, reacting the potassium hydroxide solution with hydrogen sulfide bubbled through the solution, recovering the catalyst-alcohol mixture and separating said alcohol from said solution;

wherein Catalyst B is prepared by dissolving a technical or analytical grade of a potassium hydroxide of approximately 86% potassium hydroxide, in ethanol or methanol and saturated with hydrogen sulfide in a series of vessels by introducing in a first vessel said hydrogen sulfide, but without boiling off most of the alkanol, collecting in a separate downstream vessel and trapping therein any alkanol given off by an exothermic reaction between said potassium hydroxide and hydrogen sulfide in said preceding vessel, and stopping the addition of hydrogen sulfide reaction when the last vessel containing KOH shows a reaction;

wherein Catalyst C is obtained by dissolving about 6 moles of KOH in about 9 to 15 moles of $H_2O$ without external heat being applied, and thereafter adding a small amount of alkanol, of about from 2 to 2.5 cc of methanol or ethanol per mole of elemental KOH; adding about 4 moles of elemental sulfur; adding an appropriate amount of elemental sulfur for adjusting the catalyst to the desired sulfur level by addition of supplemental elemental sulfur to form the empirical sulfide, from about $K_2S_{1.1}$ to $K_2S_5$;

wherein Catalyst D is obtained by dissolving one mole of KOH in 1.5 moles of water, adding immediately 2 ml of methanol or ethanol after KOH has dissolved; adding $\frac{2}{3}$ moles of elemental sulfur; adjusting the catalyst to the desired empirical sulfur content by adding sulfur by further stirring, said catalyst ranging from $K_2S_{1.1}$ to $K_2S_5$;

wherein Catalyst E is obtained by adding a dried KHS powder or slurry to each of the above-described catalysts or mixtures of catalysts A, B, C or D; said addition being from about 1/5 to $\frac{1}{3}$ moles on molar basis of K of KHS to $K_2S$ (empirical) sulfide to $K_2S_{2.5}$ (empirical), on molar basis.

5. The process as defined in claim 1 wherein the catalyst in step (a) or step (d) is a supported catalyst and the support is a porous metal, chromite spinel, zeolite or an alumina.

6. The process as defined in claim 1 wherein the catalyst in step (a) or step (d) is a porous metal supported catalyst and said porous metal is a stainless steel of up to 35% metal by volume.

7. The process as defined in claim 4 wherein the carbonaceous starting material reacted in step (a) is a heavy crude oil, or a residue having no boiling point, or an asphaltene and the supported catalyst is at least 75% weight percent Catalyst A in combination with Catalyst D deposited on a catalyst support.

8. The process as defined in claim 7 wherein Catalyst A is from 5% , by weight, to 80%, by weight, and balance is Catalyst D.

9. The process as defined in claim 4 wherein in step (d) the catalyst is a porous metal supported Catalyst A and wherein the reaction is at a temperature from 360° C. to 440° C.

10. The process as defined in claim 1 wherein the reaction is carried out at a pressure from subatmospheric to less than 150 psi and at a temperature from about 160° C. to about 600° C., in the presence of a supported catalyst.

11. The process as defined in claim 4 wherein the catalyst for the further reaction is a Catalyst A composition with KHS as an admixed component of up to 15%, by weight, and the resultant catalyst product is deposited on a steel support.

12. The process wherein the support for a catalyst for the reactions as defined in claim 1 is protected and wherein said support is a porous metal, chromite spinel, alumina, a zeolite, or mixed supports.

13. The process as defined in claim 12 wherein the catalyst is supported and the support is alumina of a pore size from 6Å up to 13,000Å, said alumina being protected from an attack by said catalyst by depositing said catalyst in an admixture with glycerol and calcining it with exclusion of oxygen, or a polyhydric alkanol of up to six carbon atoms, depositing on said support said glycerol or polyhydric alkanol, heating said support up to 200° C., cooling said support, and depositing then said catalyst thereon and thereafter heating said catalyst up to about 560° C.

14. The process as defined in claim 1 wherein the carbonaceous material in a second reaction zone is a residue of a first reaction zone collected in a cyclone zone held at 390° C.

15. The process as defined in claim 1 wherein after recovery of the product from step (c), part of said liquid product is split and reacted further in at least one additional second reaction zone (d), and a bottom product from zone (d) reaction is further reacted in still another reaction zone.

16. The process as defined in claim 1 wherein the reaction in step (a) and step (d) is carried out at a temperature up to 560° C.

17. The process as defined in claim 1 wherein the reaction products of a crude oil residue are reacted in said zones immediately after step (a) with quenching of the top reaction products from step (a), and while a top reaction product of step (d) is further reacted, with quenching, in a further reaction zone for hydrogenation of same.

18. The process as defined in claim 1 wherein the reaction in step (a) or step (d) is with said supported catalyst, in an ebullating bed reactor, fixed bed reactor, liquid bed reactor, or fluidized bed reactor.

19. The process as defined in claim 4 wherein the reaction in step (a) is in an ebullating bed reactor with the catalyst supported on zeolites wherein said catalyst comprises 25% of Catalyst A and 75% of Catalyst B.

20. The process as defined in claim 4 wherein the reaction in step (d) is in an ebullating bed reactor and said catalyst is supported on a zeolite as a support and said catalyst is entirely Catalyst A.

21. The process as defined in claim 4 wherein the reaction in step (a) is in a spinning basket or ebullating bed reactor, and the catalyst is a mixture of Catalyst A and Catalysts B, C and D and the amount of A is from 3% to 97%, by weight, said catalyst being supported on a zeolite, porous metal, chromite spinel, or alumina.

22. The process as defined in claim 4 wherein the reaction in step (d) is in a spinning basket or ebullating bed reactor and the catalyst is a mixture of Catalyst A and Catalysts B, C and D and the amount of A is from 50 to 100%, by weight.

23. The process as defined in claim 22, wherein Catalyst A is from 50 to 95%, by weight.

24. The process as defined in claim 4, wherein the top product to steps (a) and (d) reactions are further reacted before these are hydrogenated.

25. The process as defined in claim 24, wherein the top products of steps (a) and (d) are hydrogenated with Catalyst A with KOH added thereto; Catalyst C with KHS admixed thereto; Catalysts B and A, with 50% or more of Catalyst B on K mole basis, or Catalyst B.

* * * * *

UNITED STATES PATENT AND TRADEMARK OFFICE

CERTIFICATE OF CORRECTION

PATENT NO. : 4,473,462

DATED : September 25, 1984

INVENTOR(S) : ROLLAN SWANSON

It is certified that error appears in the above-identified patent and that said Letters Patent is hereby corrected as shown below:

On the first page of the patent, delete the assignment data, item No. 73.

In the ABSTRACT, Line 2 after "petroleum," delete "* or other hydrocarbon *."

In col. 3, line 24, delete "cyclon," and insert "* cyclone *."

In col. 3, line 42, after the word "oil" insert a "comma."

In col. 4, line 33, after the number "22," delete "* including the minus num- *."

In col. 4, line 34, delete "*** ber API crudes."

Signed and Sealed this

Sixth Day of August 1985

[SEAL]

*Attest:*

DONALD J. QUIGG

*Attesting Officer*

*Acting Commissioner of Patents and Trademarks*